US006632300B2

(12) United States Patent
Breedis et al.

(10) Patent No.: US 6,632,300 B2
(45) Date of Patent: Oct. 14, 2003

(54) COPPER ALLOY HAVING IMPROVED STRESS RELAXATION RESISTANCE

(75) Inventors: John F. Breedis, Trumbull, CT (US); Dennis R. Brauer, Brighton, IL (US); Peter W. Robinson, Branford, CT (US)

(73) Assignee: Olin Corporation, New Haven, CT (US)

( * ) Notice: Subject to any disclaimer, the term of this patent is extended or adjusted under 35 U.S.C. 154(b) by 64 days.

(21) Appl. No.: 09/879,616

(22) Filed: Jun. 12, 2001

(65) Prior Publication Data

US 2002/0044881 A1 Apr. 18, 2002

Related U.S. Application Data

(60) Provisional application No. 60/214,211, filed on Jun. 26, 2000.

(51) Int. Cl.[7] ..... C22C 9/04

(52) U.S. Cl. ..... 148/434; 148/433; 420/477; 420/478; 420/479; 420/480; 420/481; 420/482; 420/483; 420/484

(58) Field of Search ..... 148/433, 434; 420/477, 478, 479, 480, 481, 482, 483, 484

(56) References Cited

U.S. PATENT DOCUMENTS

| | | | | |
|---|---|---|---|---|
| 3,039,867 | A | | 6/1962 | McLain |
| 3,522,038 | A | | 7/1970 | McLain |
| 3,522,039 | A | | 7/1970 | McLain |
| 3,522,112 | A | | 7/1970 | McLain |
| 3,671,225 | A | | 6/1972 | McLain |
| 4,305,762 | A | | 12/1981 | Caron et al. |
| 4,605,532 | A | | 8/1986 | Knorr et al. |
| 4,668,471 | A | | 5/1987 | Futatsuka et al. |
| 5,868,877 | A | | 2/1999 | Brenneman |
| 5,882,442 | A | * | 3/1999 | Caron et al. ..... 148/433 |

FOREIGN PATENT DOCUMENTS

| | | | |
|---|---|---|---|
| JP | 62047465 | * | 3/1987 |
| JP | 62093325 | * | 4/1987 |
| JP | 02043350 | * | 2/1990 |
| JP | 4358033 | * | 12/1992 |
| JP | 11-264037 | | 9/1999 |
| JP | 2000 17353 | * | 1/2000 |
| JP | 2000 17354 | * | 1/2000 |

* cited by examiner

*Primary Examiner*—Sikyin Ip
(74) *Attorney, Agent, or Firm*—Gregory S. Rosenblatt; Wiggin & Dana LLP

(57) ABSTRACT

A copper alloy having improved stress relaxation resistance is formed from a copper base alloy that consists, by weight, essentially of 1.8%–3.0% iron, 0.01%–1.0% zinc, 0.001 %–0.25% phosphorus, 0.1 %–0.35% magnesium and the balance is copper and unavoidable impurities. When compared to other copper base alloys that include iron, zinc and phosphorous, the disclosed alloy has improved resistance to stress relaxation. In addition, directionality of stress relaxation resistance (where stress relaxation resistance is typically poorer in a transverse strip direction relative to a longitudinal strip direction for a copper alloy that is strengthened by cold rolling) is reduced to being nearly equivalent, regardless of strip direction. The alloy is particularly useful for electronic applications, such as being formed into an electrical connectors.

9 Claims, 11 Drawing Sheets

COLD ROLLED 30%
RELIEF ANNEALED 300° C/4 HOURS.

COLD ROLLED 30%
RELIEF ANNEALED 300° C/4 HOURS.

COLD ROLLED 58%
RELIEF ANNEALED 275° C/4 HOURS.

COLD ROLLED 30%
RELIEF ANNEALED 300° C/4 HOURS.

COLD ROLLED 58%
RELIEF ANNEALED 275° C/4 HOURS.

COLD ROLLED 58%
RELIEF ANNEALED 275° C/4 HOURS.

DIFFERENCE BETWEEN LONGITUDINAL (L) AND TRANSVERSE (T) RELAXATION AFTER 3000 HOURS AT 105°C TEST TEMPERATURE.

DIFFERENCE BETWEEN LONGITUDINAL (L) AND TRANSVERSE (T) RELAXATION AFTER 3000 HOURS AT 125°C TEST TEMPERATURE.

DIFFERENCE BETWEEN LONGITUDINAL (L) AND TRANSVERSE (T) RELAXATION AFTER 3000 HOURS AT 150°C TEST TEMPERATURE.

COPPER ALLOY HAVING IMPROVED STRESS RELAXATION RESISTANCE

CROSS REFERENCE TO RELATED PATENT APPLICATION

This patent application claims priority to United States Provisional Patent Application Ser. No. 60/214,211 that was filed on Jun. 26, 2000. The subject matter of that provisional patent application is incorporated by reference in its entirety herein.

BACKGROUND OF THE INVENTION

1. Field of the Invention

This invention relates to a copper base alloy that is particularly suited to be formed into electrical connectors. The copper base alloy contains iron, phosphorous and zinc to which magnesium is added within certain limits. The alloy provides improved stress relaxation resistance at elevated temperatures. The alloy also provides an excellent combination of properties including high electrical conductivity, excellent bend formability and high strength.

2. Description of Related Art

Alloys of copper with iron, zinc and phosphorus, represent an important group of high copper alloys (defined as having 96% minimum copper). High copper alloys are used for a broad range of applications that require moderate to high electrical conductivity in combination with high strength and adequate formability. An important use for this group of copper alloys is for the spring contact member in electrical connectors. High contact force, and associated low contact resistance, is attainable because of these alloys' strength. The good electrical conductivity typical of these alloys also permits management of large electrical currents without unacceptable resistance heating.

However, high copper alloys of the group that further includes iron, zinc and phosphorous are typically limited to service temperatures below around 100° C. (212° F.) because of limited resistance to losses in contact force during prolonged thermal exposure, a phenomenon referred to as stress relaxation.

One high copper alloy used to manufacture electrical connector components is designated by the Copper Development Association ("CDA", New York, N.Y.) as copper alloy C19400. Copper alloy C19400 has a composition specified by CDA, by weight, 2.1%–2.6% iron, 0.05%–0.20% zinc, 0.015%–0.15% phosphorous, and the balance copper and unavoidable impurities. Alloys of this type are disclosed in U.S. Pat. Nos. 3,039,867, 3,522,039 and 3,522,112 to C. D. McLain, all of which are incorporated by reference in their entireties herein. Copper alloy C19400 has been utilized for lead materials, such as leadframes, as well as for connector applications.

Various attempts have been made to modify copper alloy C19400 through the addition of other elements, such as aluminum, silicon, manganese or magnesium, in small amounts. U.S. Pat. Nos. 3,522,038 to C. D. McLain, 3,671,225 to C. D. McLain, 3,671,225 to C. D. McLain and 4,668,471 to Futatsuka et al. are illustrative of such attempts. These four U.S. patents are also incorporated by reference in their entireties herein.

The Futatsuka patent relates to a copper alloy lead material for leads in semiconductor devices. The alloy is comprised of 2–2.4 wt. % iron, 0.001–0.1 wt. % phosphorous, 0.01–1 wt. % zinc, 0.001 to 0.1 wt. % magnesium and the balance copper and inevitable impurities. The patent recites that magnesium improves strength, heat resistance and soldering reliability of the material for leads without sacrificing the elongation and conductivity of the alloy. Heat resistance refers to the ability of an alloy to resist softening due to recovery and recrystallization upon exposure to elevated temperatures in the absence of an externally applied stress. Heat resistance is distinguished from stress relaxation resistance which is the ability of an alloy to maintain its spring force in use at temperatures below its recrystallization temperature.

The Futatsuka patent limits the upper limit of the magnesium addition to 0.1 wt. % and states that if the magnesium content exceeds that level the lead material will have degraded electrical conductivity and the molten alloy will have degraded fluidity, thus making casting of the alloy difficult.

Magnesium has been proposed for use in a number of high copper alloys. U.S. Pat. No. 3,698,965 discloses an alloy having 0.2–4.0 wt. % iron, 0.10–1.0 wt. % of a material selected from magnesium, tin and mixtures thereof, 0.01–0.5 wt. % phosphorous, 0.2–2.5 wt. % cobalt, with iron plus cobalt being between 1–5 wt. % and the remainder copper. U.S. Pat. No. 4,605,532 discloses a copper alloy containing 0.3–1.6 wt. % iron, with up to one-half the iron content being replaced by nickel, manganese, cobalt, and mixtures thereof, 0.01–0.20 wt. % magnesium, 0.10–0.40 wt. % phosphorous, up to about 0.5 wt. % tin or antimony or mixtures thereof and the balance copper. In this alloy the phosphorous to magnesium ratio and the phosphorus to the total content of phosphide formers ratio are maintained within critical limits. U.S. Pat. No. 5,868,877 discloses a copper alloy having 0.1–0.17 wt. % phosphorous, 0.1–1.5 wt. % iron and the balance is copper and unavoidable impurities. The '877 patent discloses that the alloy requires free magnesium in solid solution in accordance with a specific formula to improve stress relaxation resistance.

In accordance with the '877 patent, it is understood that "free magnesium" refers to magnesium in solution with copper as opposed to a form that precipitates from the alloy matrix during processing.

The maximum iron content, however, claimed in the '532 and '877 patents is 1.6% and 1.5%, respectively and the minimum phosphorus content is 0.1% in both patents. In the '965 patent, magnesium is consumed by the tin as an intermetallic phase. These high copper alloys are separate and distinct alloys as compared to the copper alloys of this invention and the effects of magnesium in these alloys do not provide predictability of the effect of magnesium in the inventive alloys. These patents are incorporated by reference in their entireties herein.

Other patents that disclose high copper alloys containing iron, phosphorous and magnesium with even lower iron contents include U.S. Pat. Nos. 4,305,762 and 4,605,532 and published Japanese Patent Application No. JP 58-199835.

JP11-264037 discloses a foil formed from a copper alloy that contains, by weight, 0.05%–3.5% iron and 0.01%–0.4% phosphorous. Optionally the alloy may contain one or both of 0.05%–5% zinc and 0.05%–3% tin. The alloy may further contain one or more of Mg, Co, Pb, Zn, Cr, Mn, Al, Ni, Si, In and B in an amount of 0.01%–2% in total.

Modern electronic connector applications require materials which exhibit excellent stress relaxation resistance when exposed to elevated temperature environments in order to insure sustained reliable electrical contact. For example, in automotive environments an electrical connector in the engine compartment can be exposed to operating temperatures above 100° C. Improvement in the stress relaxation resistance of high copper alloys is needed to meet the increased requirements posed by such modern connector applications.

SUMMARY OF THE INVENTION

The design of electrical/electronic connectors, particularly for use in the automotive industry, has become much more complex and miniaturized. This has imposed increasingly higher stress relaxation demands on the copper alloys from which they are made. This invention concerns improving the resistance to stress relaxation of a copper-iron-phosphorus-zinc alloy by a controlled addition of magnesium, while maintaining a good combination of strength, electrical conductivity and formability. The alloy of this invention provides an excellent combination of properties including good bend formability, high strength and improved resistance to stress relaxation at elevated temperatures.

In accordance with this invention, a copper alloy is provided having improved resistance to stress relaxation. The alloy consist essentially of: from about 1.8 to 3.0 weight percent iron; from about 0.01 to about 1.0 weight percent zinc; from about 0.001 to about 0.25 weight percent phosphorous; from greater than about 0.1 to about 0.35 weight percent magnesium; and the balance copper and unavoidable impurities.

Preferably the copper alloy includes: iron from about 2.0 to 2.7 weight percent; zinc from about 0.01 to about 0.5 weight percent; phosphorous from about 0.010 to about 0.15 weight percent; and magnesium from about 0.11 to about 0.30 weight percent.

Most preferably, the copper alloy includes: iron from about 2.1 to 2.6 weight percent; zinc from about 0.05 to about 0.25 weight percent; phosphorous from about 0.01 to about 0.09 weight percent; and magnesium from about 0.15 to about 0.25 weight percent.

Optionally, cobalt may be substituted, in whole or in part, on a 1:1 basis by weight, for iron.

The copper alloy in the stress relief annealed condition preferably has a yield strength of from 45 to 80 ksi, an electrical conductivity of greater than or equal to 60% IACS, stress relaxation resistance at 150° centigrade of at least 70% longitudinal stress remaining after 3000 hours exposure and good bend formability.

IACS refers to International Annealed Copper Standard that assigns a conductivity value of 100% to "pure" copper at 20° C.

Preferably the alloy of the invention is in a stress relief annealed condition and is substantially free of magnesium phosphides. The preferred use of the alloy of this invention is for electrical/electronic connector applications, although the alloy may be used in any application where its unique combination of properties makes it suitable, such as without limitation, leadframes or other electronic uses, wires, rods and foil.

A process for making a copper alloy in accordance with this invention also forms part of the invention. An electrical connector formed from the copper alloy of this invention also forms part of this invention.

Accordingly, it is an aim of the present invention to provide an improved copper base alloy and the process for making it, which will provide an alloy having increased stress relaxation resistance.

It is a further aim of this invention to provide a high copper alloy to which magnesium is added within certain limits.

It is a still further aim of this invention, in accordance with a preferred embodiment thereof, to provide an alloy which has an excellent combination of properties including good bend formability, high strength, excellent stampability and improved resistance to stress relaxation at elevated temperatures.

The above stated objects, features and advantages will become more apparent from the specification and the drawings that follows.

IN THE DRAWINGS

Figure 3:
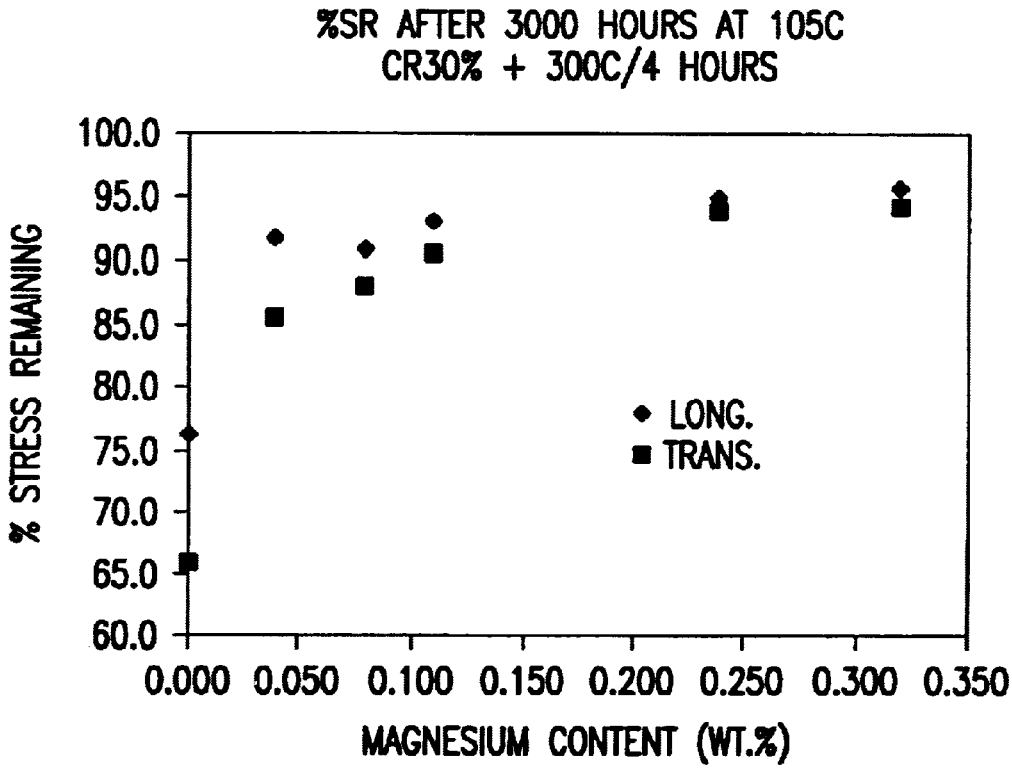

FIG. 3 graphically illustrates the percent stress remaining as a function of magnesium content after 3,000 hours at 105° C. for a copper alloy strip cold rolled 30% to final gauge.

Figure 4:
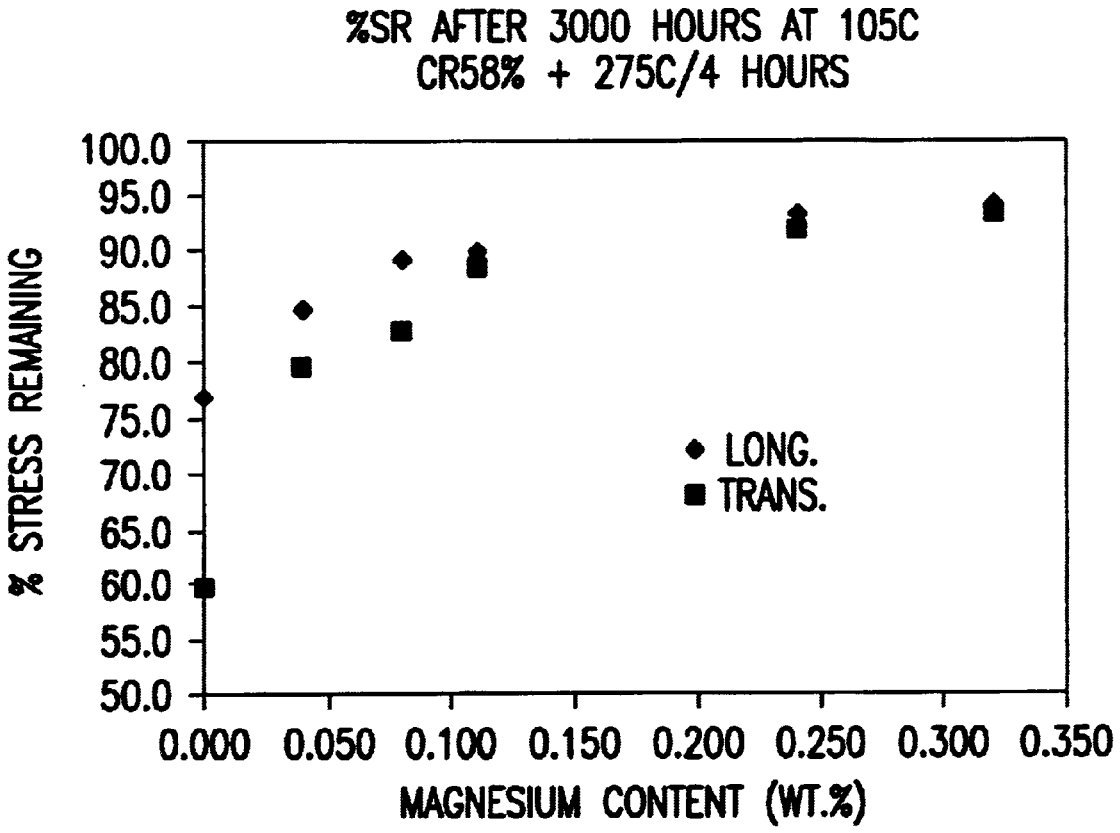

FIG. 4 graphically illustrates the percent stress remaining as a function of magnesium content after 3,000 hours at 105° C. for a copper alloy strip cold rolled 58% to final gauge.

Figure 5:
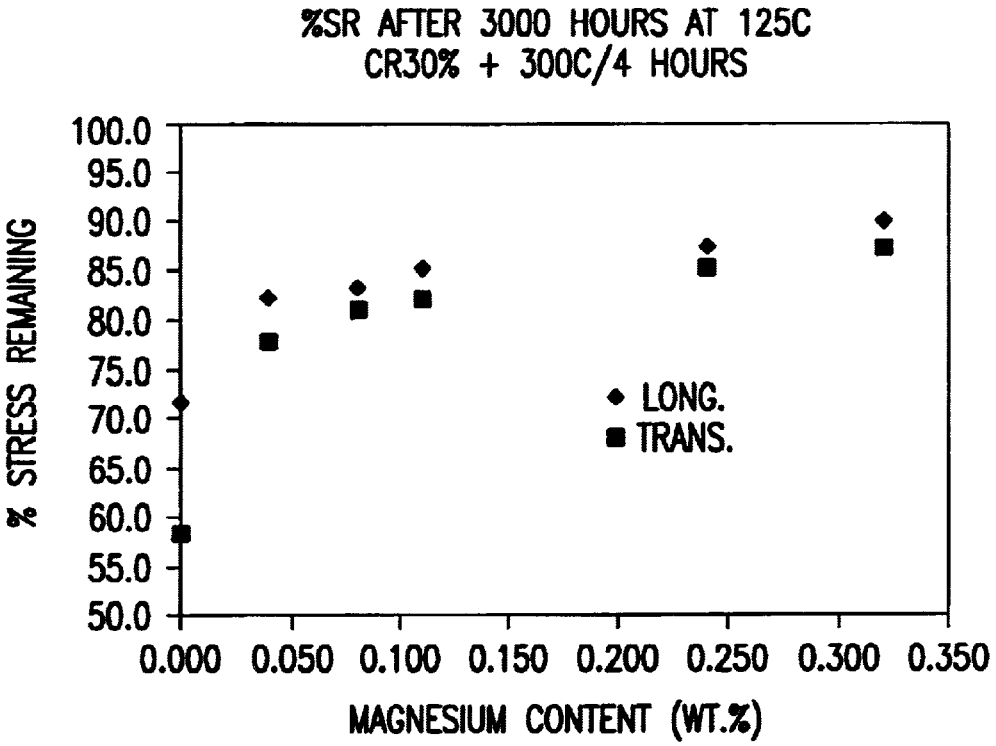

FIG. 5 graphically illustrates the percent stress remaining as a function of magnesium content after 3,000 hours at 125° C. for a copper alloy strip cold rolled 30% to final gauge.

Figure 6:
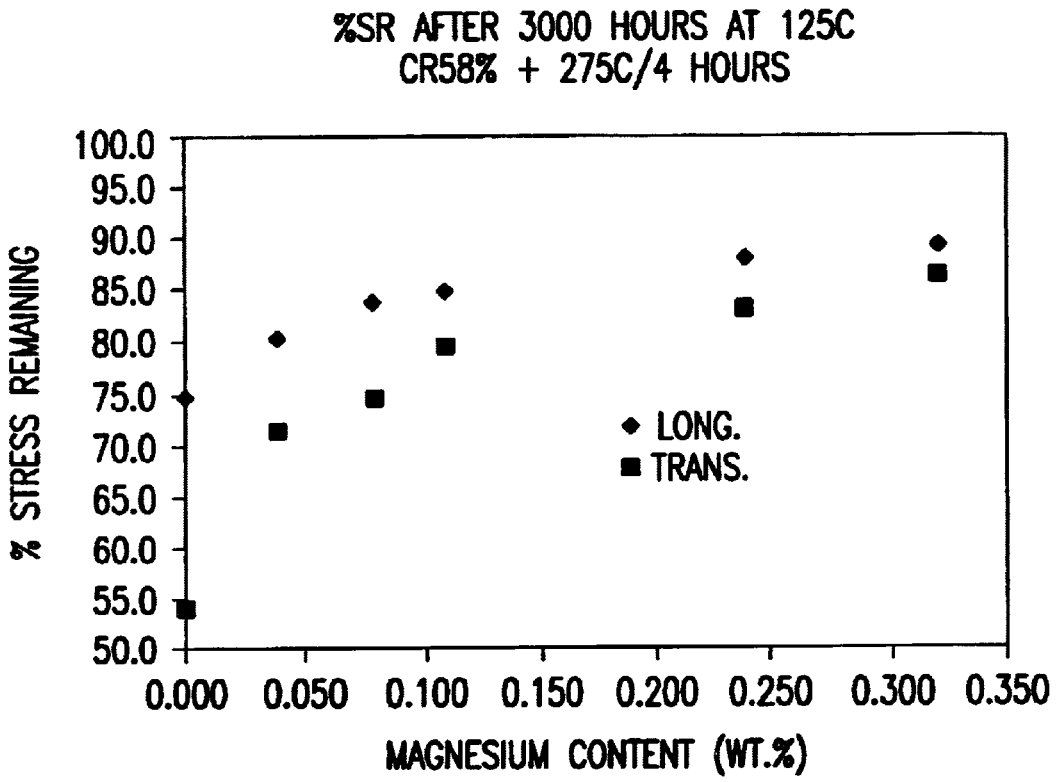

FIG. 6 graphically illustrates the percent stress remaining as a function of magnesium content after 3,000 hours at 125° C. for a copper alloy strip cold rolled 58% to final gauge.

Figure 7:
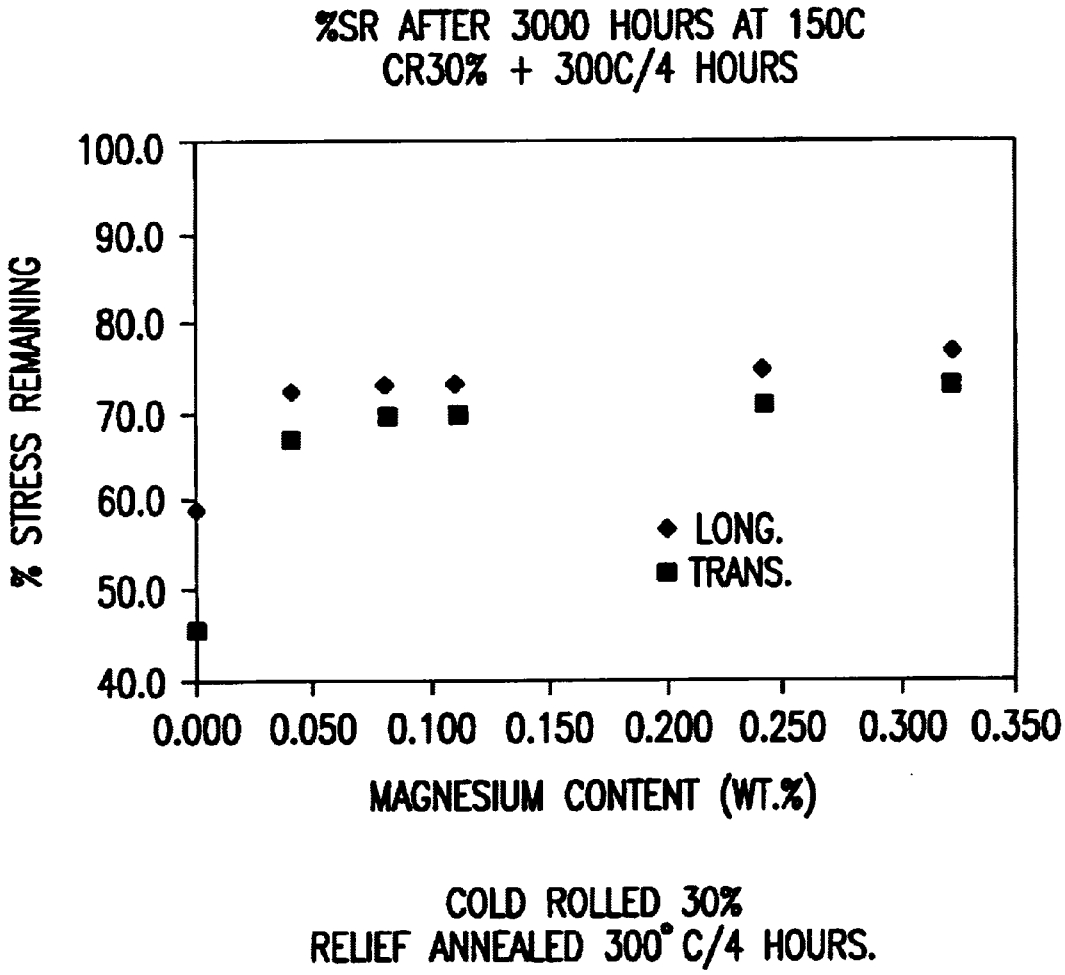

FIG. 7 graphically illustrates the percent stress remaining as a function of magnesium content after 3,000 hours at 150° C. for a copper alloy strip cold rolled 30% to final gauge.

Figure 8:
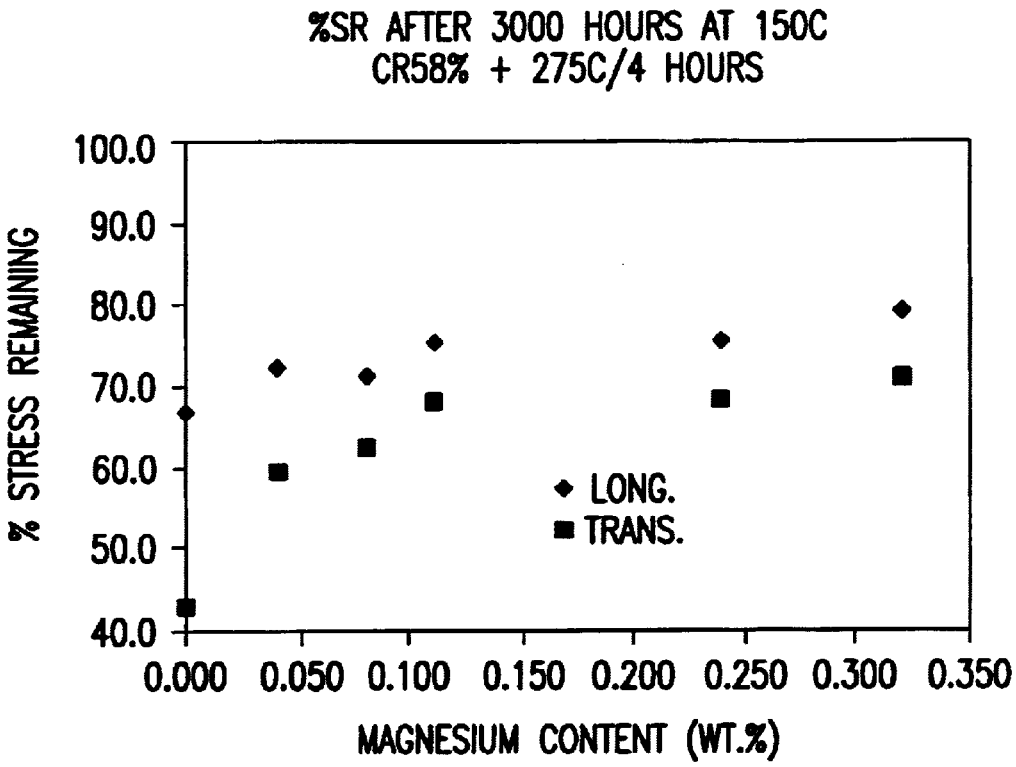

FIG. 8 graphically illustrates the percent stress remaining as a function of magnesium content after 3,000 hours at 150° C. for a copper alloy strip cold rolled 58% to final gauge.

Figure 9:
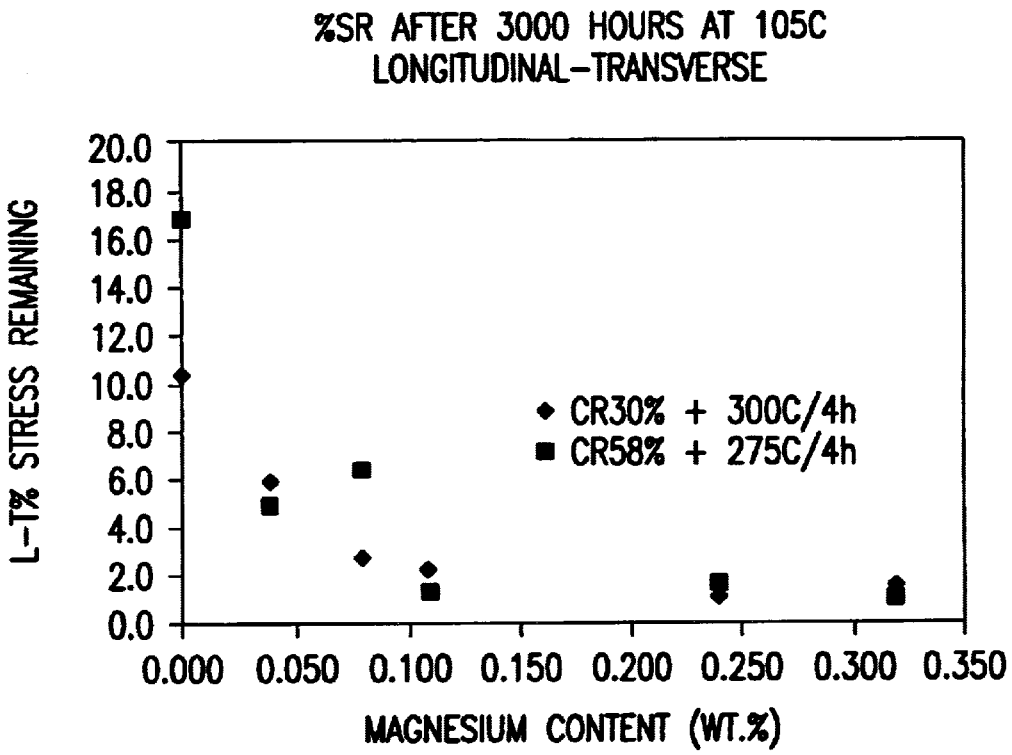

FIG. 9 graphically illustrates the difference in percent stress remaining between the longitudinal and transverse directions as a function of magnesium content after 3,000 hours at 105° C.

Figure 10:
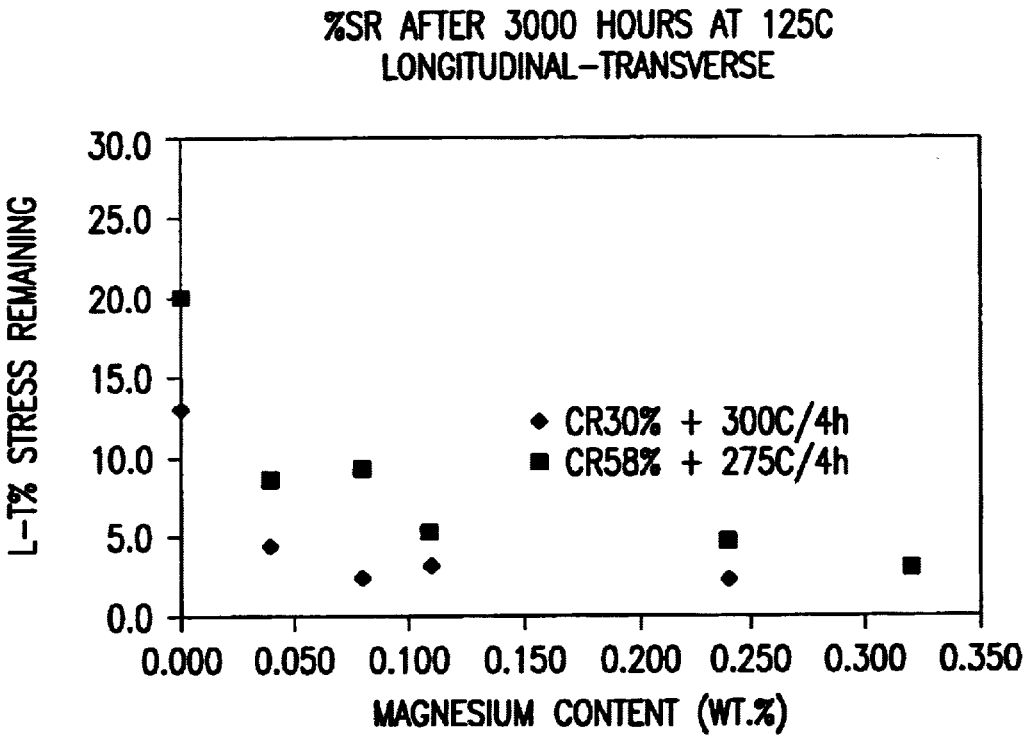

FIG. 10 graphically illustrates the difference in percent stress remaining between the longitudinal and transverse directions as a function of magnesium content after 3,000 hours at 125° C.

Figure 11:
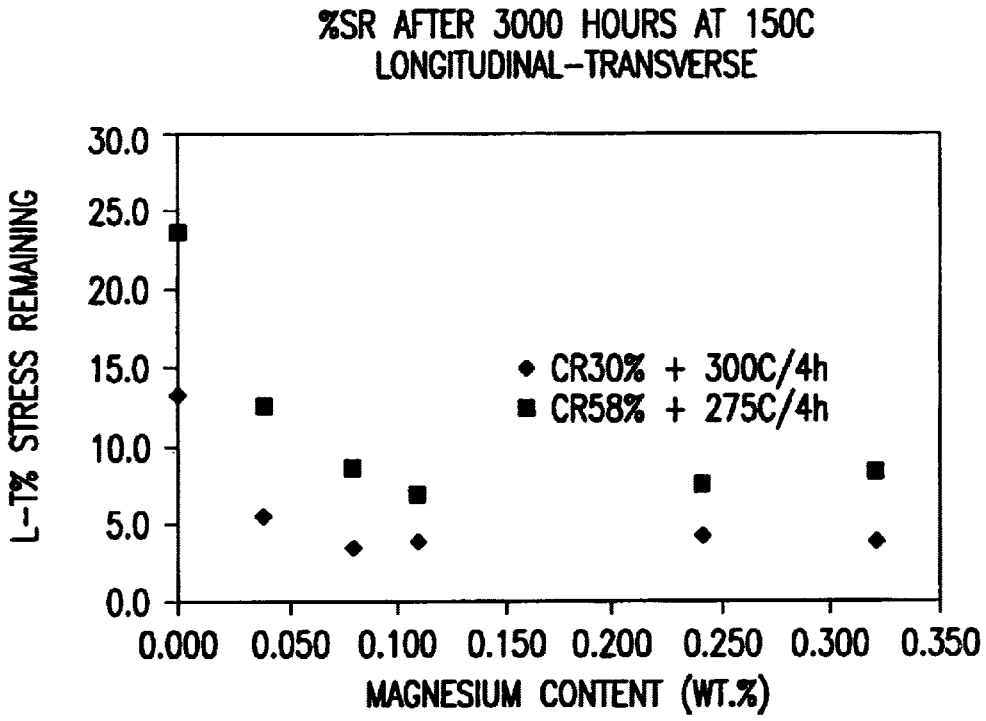

FIG. 11 graphically illustrates the difference in percent stress remaining between the longitudinal and transverse directions as a function of magnesium content after 3,000 hours at 150° C.

DETAILED DESCRIPTION

Throughout this patent application, physical and electrical properties are measured at a nominal 20° C. unless otherwise noted The design of electrical/electronic connectors, particularly for use in the automotive industry, has become much more complex and has imposed increasingly higher demands relating to stress relaxation resistance on the copper alloys from which the conductors are made.

Stress relaxation is a phenomenon that occurs when an external elastic stress is applied to a piece of metal. The metal reacts by developing an equal and opposite internal elastic stress. If the metal is restrained in the stressed position, the internal elastic stress decreases as a function of time. The gradual decrease in internal elastic stress is called stress relaxation and happens because of the replacement of elastic strain in the metal, by plastic or permanent strain. The rate of decrease of internal stress with time is a function of alloy composition, alloy temper, orientation relative to processing direction (e.g. longitudinal orientation = the rolling direction) and exposure temperature. It is desirable to reduce the rate of decrease, ie. to increase the resistance to stress relaxation, as much as possible for spring and connector applications.

Figure 1:
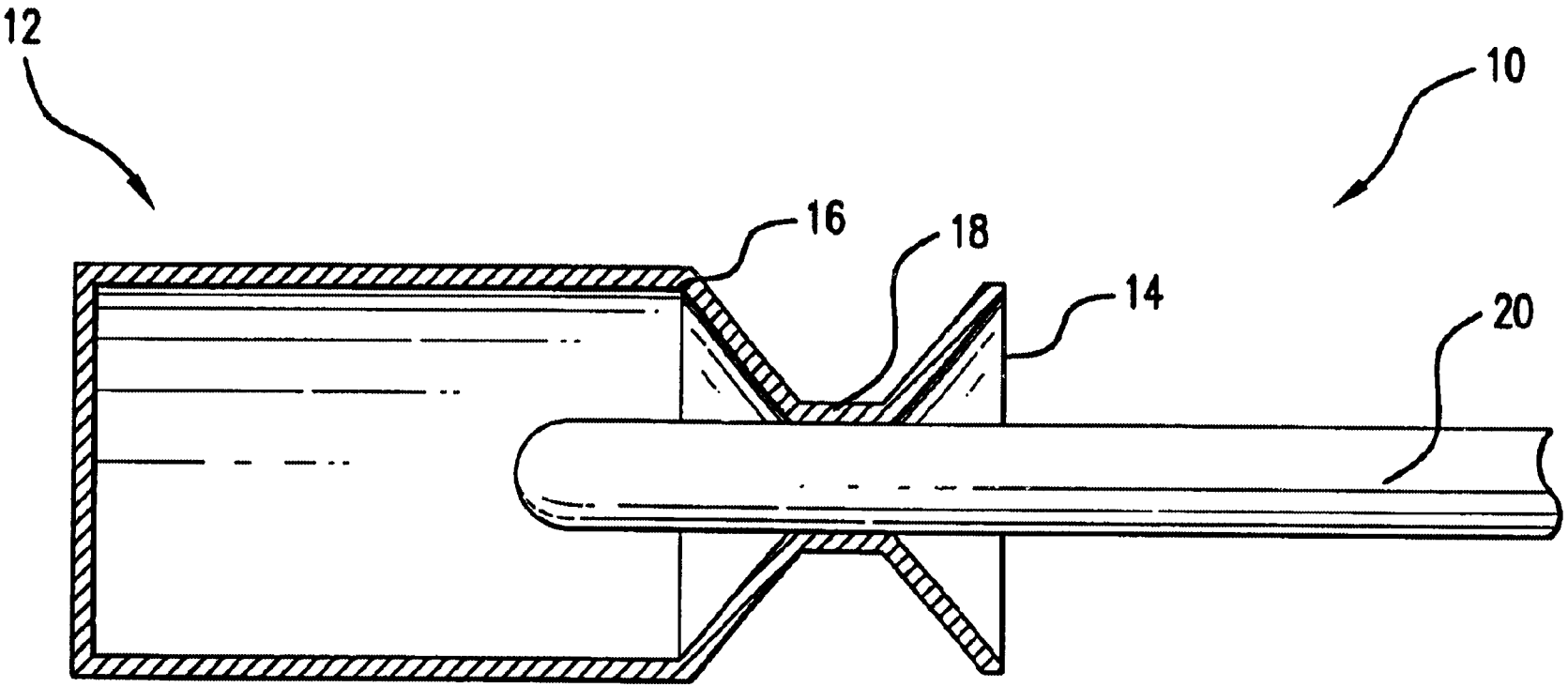
FIG. 1 is a cross-sectional representation of an electrical connector including a socket formed from the copper alloy of the invention.

With reference to FIG. 1, in the manufacture of an electrical connector system 10, a sheet of copper alloy may be formed into a hollow shape for use as a socket 12. In the automotive field, box shaped sockets have found particular application. Metal adjacent to an open end 14 of the copper alloy socket is externally stressed 16, such as by bending, to develop an opposing internal stress effective to cause open end portion 18 of the copper alloy socket 12 to bias inwardly and tightly engage or contact a mating plug 20. This tight engagement insures that the electrical resistance across the socket 12 and plug 20 connector components remains relatively constant and that, the plug resists separation from the socket in extreme conditions, such as excessive vibration.

Over time, and more rapidly at higher temperatures, stress relaxation weakens the contact force between the socket 12 and the plug 20 and may eventually lead to connector failure. It is a primary objective of electrical connector design to maximize the contact force between the socket and the plug to maintain good electrical conductivity through the connector.

It has surprisingly been found that the stress relaxation resistance of a copper alloy containing iron, phosphorous and zinc can be significantly improved by adding greater than 0.1 wt. % magnesium and limiting the maximum phosphorous content to that which can be substantially combined with iron as iron phosphides rather than forming magnesium phosphides. The alloy also provides an excellent combination of properties including good bend formability and high strength.

The alloy of the invention consists essentially of: from about 1.8 to about 3.0 weight percent iron; from about 0.01 to about 1.0 weight percent zinc; from about 0.001 to about 0.25 weight percent phosphorous; from greater than 0.1 to about 0.35 weight percent magnesium; and the balance copper and unavoidable impurities.

In a preferred embodiment of this invention, the iron content is from about 2.0 to about 2.7 weight percent, the magnesium content is from about 0.11 to about 0.30 weight percent, the zinc content is from 0.01 to 0.5 weight percent, the phosphorous content is from about 0.01 to about 0.15 weight percent and the alloy is substantially free of magnesium phosphides.

In a most preferred embodiment of this invention, the iron is limited to from about 2.1 to about 2.6 weight percent and the magnesium is limited to from about 0.12 to about 0.25 weight percent. The zinc content is from 0.05 to 0.25 weight percent and the phosphorous content is from 0.015 to 0.09 weight percent. The balance of the alloy is copper and inevitable impurities.

In accordance with an alternative embodiment of this invention cobalt may be substituted, in whole or in part, on a 1:1 basis by weight, for iron.

The magnesium content in accordance with the limits of this invention is critical. When magnesium is present in amounts below the bottom limit of this invention, stress relaxation resistance is reduced. If magnesium is present in amounts above the limits of this invention electrical conductivity is reduced. Further as magnesium is increased above the limits of this invention there is believed to be no real benefit to the stress relaxation resistance of the alloy.

The magnesium addition to the alloys of this invention, together with a limited phosphorus content for melt deoxidization, enhances resistance to stress relaxation in the alloy which is preferably intended for elevated temperature connector usage.

The alloys of the invention may include inevitable impurities in amounts recognized to those skilled in the art as an impurity as well as small amounts of other, unspecified, alloying additions that do not significantly reduce alloy strength, resistance to stress relaxation and electrical conductivity. These unspecified additions include manganese, beryllium, silicon, zirconium, titanium, chromium and mixtures thereof. The unspecified additions are preferably present in an amount less than about 0.2% each, and most preferably, in an amount of less than about 0.01%. Most preferably, the sum of all less preferred alloying additions is less than about 0.1%.

Preferably the alloys have less than 0.1% of constituents that can react with magnesium to remove this element from solution. Preferably the alloys of this invention exhibit either no or a minimal amount of intermetallic phases of magnesium+alloy-constituent in their microstructure. For example, it is believed that magnesium in combination with tin (as in tin-bronze and tin-brass alloys) negates magnesium's benefit to improved resistance to stress relaxation because the magnesium is essentially consumed through a reaction with tin to form a magnesium-tin intermetallic phase.

In many earlier magnesium containing alloys, both iron and magnesium phosphides may form since the iron content can be insufficient to first tie-up all phosphorus as iron phosphide.

Iron phosphide is more stable than magnesium phosphide. Magnesium phosphide becomes increasingly unstable above around 500° C. It is believed that for the alloys of this invention, with around 0.25% maximum phosphorus, only a small amount of iron in the alloy is needed to fix all phosphorus into iron phosphide. In certain prior art alloys, stress relaxation performance can vary, depending upon the combination of iron, phosphorus and magnesium in the alloy. Dissolved magnesium acts to enhance resistance to stress relaxation, so that removing this element from solution as a phosphide is not desired. The alloys of this invention are not expected to contain any significant amount of stable magnesium phosphides.

Since precipitation of magnesium phosphides is not likely in the alloys of this invention, the amount of dissolved magnesium required for providing predictable high resistance to stress relaxation does not have to be controlled within the limits of various formulas as required by the prior art.

The copper alloys of this invention generally possess a yield strength of from 45 to 80 ksi, an electrical conductivity of greater than or equal to 60% IACS, stress relaxation resistance comprising the stress remaining after 3000 hours exposure at 150° centigrade of at least 70% longitudinal and good bend formability. The alloys of this invention are particularly useful in electrical or electronic connector applications, although they may be used in any application where their unique combination of properties make them suitable, such as without limitation, leadframes or other electronic uses, wires, rods and foils. Such copper alloy foils are frequently bonded to a dielectric and formed into circuit traces for printed circuit boards and flex circuits. The alloys of this invention show excellent hot and cold workability.

The alloys of this invention can be prepared by conventional induction melting and semicontinuous casting, followed by hot and cold rolling with appropriate intermediate and finish gauge annealing treatments. Alternatively they can be prepared by strip casting and cold rolling with appropriate intermediate and finish gauge annealing treatments.

Figure 2:
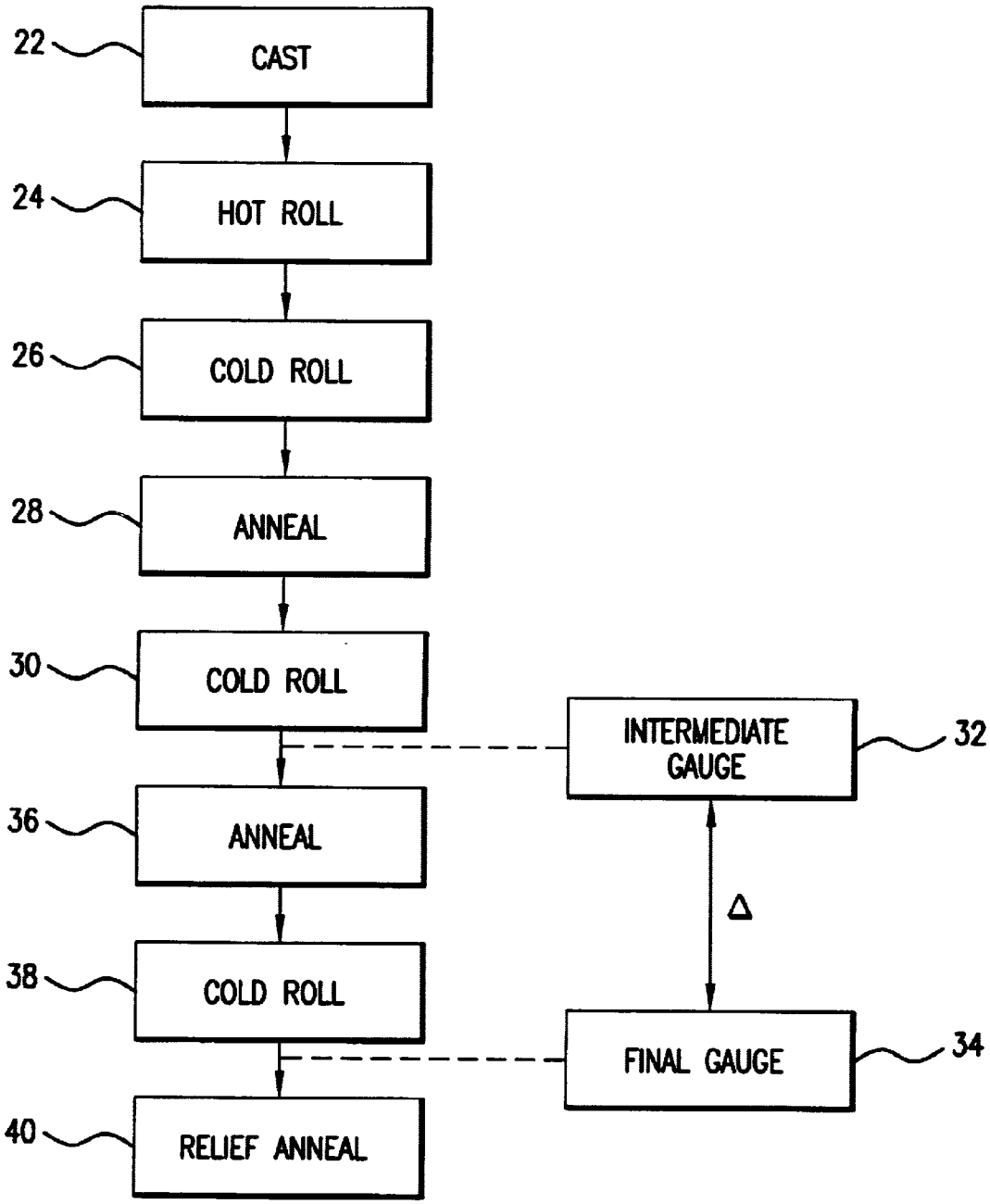
FIG. 2 illustrates in block diagram a process flow to manufacture the copper alloy of the invention in strip form.

The alloys of this invention can be cast by any desired conventional casting process such as, without limitation, direct chill semicontinuous casting or strip casting. With reference to FIG. 2, if the alloys are not strip cast, the alloy is cast 22 from a molten mixture to form a homogenous ingot of a desired composition. The ingot is reheated to a temperature of between about 750° C. and 950° C., and most preferably in the range of about 825° C. to 925° C., and hot rolled 24 to form a slab.

Optionally, but preferably, the slab is then milled or chemically treated to remove oxides. The slab may also be annealed following hot rolling 24, but preferably cold roll reduction 26 follows hot rolling 24 without an intervening anneal.

The slab is then cold rolled 26 and annealed 28 at a temperature effective for precipitation of an iron phase and an iron phosphide phase. One suitable anneal 28 is a bell anneal at a temperature in the range of about 500° C. to 600° C. and most preferably about 550° C. to 580° C., for a period at temperature of at least about 1 hour and most preferably about 5 hours to about 10 hours.

The alloys are then cold rolled 30 up to about 70% reduction in thickness in either one or multiple rolling passes. The slab is formed into a strip with an intermediate thickness 32. As disclosed below, the intermediate thickness is a function of a desired final gauge 34 and desired final gauge temper. Following cold reduction 30, in accordance with a first preferred embodiment of the process of this invention, the alloys are annealed 36 at a temperature of about 425° C. to about 550° C. and most preferably from about 475° C. to about 525° C. for a period at temperature of at least 1 hour and most preferably for a period of from about 6 to about 10 hours to precipitate dissolved iron phase thereby enhancing electrical conductivity.

The alloys in accordance with a preferred process embodiment are cold rolled 38 in one or more rolling steps for up to about a 75% reduction in thickness to achieve final gauge 34. The reduction in thickness, Δ, is dependent on the desired temper of the final gauge 34 strip and is between a 5% and 75% reduction in thickness. Preferably, A is between a 10% and 60% reduction in thickness.

The larger Δ, the harder the temper. For a first preferred temper (e.g. half-hard condition), Δ is preferably in the range of from about 10% to 20% reduction in thickness. For a second preferred temper (e.g. hard condition), Δ is preferably in the range of from about 30% to 50% reduction in thickness. For a third preferred temper (e.g. spring condition), Δ is preferably in the range of from about 50% to 70% reduction in thickness.

The alloys in accordance with this preferred embodiment are then preferably stress relief annealed 40 at a temperature in the range of about 200° C. to about 425° C. for from about 30 seconds to about 5 hours at temperature. More preferably the stress relief anneal 40 is at a temperature in the range of about 250° C. to about 400° C. for a period of about 1 minute to about 5 hours at temperature with the time the alloy is at temperature being inversely related to exposure time so that the time at temperature decreases with increasing temperature.

While particularly described with reference to connectors and leadframes, the alloys of the invention may be formed into other useful products, such as wire, rods and foils.

The advantages of the alloys of the invention will become more apparent from the examples that follow.

EXAMPLES

Example 1

Copper alloys with the compositions, by weight, recited in Table 1 were Durville cast 22 forming an ingot with a thickness of 1.75 inches, soaked for 2 hours at 880° C., hot rolled 24 in six passes to a slab with a thickness of 0.5 inch, and water quenched.

TABLE 1

| Analyzed Compositions of J404–J409 | | | | |
|---|---|---|---|---|
| | Element (wt. %) | | | |
| Alloy | Iron | Zinc | Phosphorus | Magnesium |
| J404 | 2.130 | 0.110 | 0.037 | <0.005 |
| J405 | 2.210 | 0.090 | 0.038 | 0.040 |
| J406 | 2.260 | 0.090 | 0.042 | 0.080 |
| J407 | 2.200 | 0.100 | 0.043 | 0.110 |
| J408 | 2.300 | 0.100 | 0.045 | 0.240 |
| J409 | 2.310 | 0.100 | 0.045 | 0.320 |

The slab was cold rolled 26 in multiple cold rolling steps to a strip having a thickness of 0.056 inch. The strip was annealed 28 at 570° C. for 8 hours. Following this anneal, the strip was cold rolled 30 to an intermediate gauge 32 of 0.024 inch and annealed 36 at 525° C. for 8 hours to achieve a fully recrystallized microstructure with a uniform grain size.

Following anneal 36, a portion of the intermediate gauge 32 strip was cold rolled 38 to a final gauge 34 of 0.0168 inch, a 30% reduction in thickness. Another portion of the intermediate gauge 32 strip was cold rolled 38 to a final gauge 34 of 0.010 inch, a 58% reduction in thickness. The strips at final gauge 34 were then relief annealed 40 for 4 hours at a temperature of 275° C. or 300° C. as reported in Table 2.

Table 2 reports the mechanical and electrical properties of the alloys of the invention, following cold roll 38 and, where indicated, following relief anneal 40.

TABLE 2

Tensile, Conductivity and Bend Formability Data on Finish Gage Material

| Condition | Alloy | YS(ksi)* | TS(ksi)* | % EL | % IACS | 90° MBR/t | |
|---|---|---|---|---|---|---|---|
| | | | | | | Goodway | Badway |
| Cold Rolled 30% | J404 | 63 | 65.4 | 2 | 64.4 | Not measured | |
| | J405 | 64.4 | 66.6 | 2.8 | 63.5 | | |
| | J406 | 68 | 70.4 | 2.6 | 64.7 | | |
| | J407 | 69.7 | 72.3 | 2.5 | 62.5 | | |
| | J408 | 72.6 | 75.2 | 2.2 | 60.2 | | |
| | J409 | 76 | 78.2 | 2.5 | 58.9 | | |
| Cold Rolled 30% + 300° C./4 hours | J404 | 58.6 | 61.5 | 6.6 | 66 | 0.5 | 0.5 |
| | J405 | 59.1 | 62.6 | 7.9 | 64.4 | 0.5 | 0.4 |
| | J406 | 62.1 | 65.5 | 6.4 | 64.7 | 0.4 | 0.5 |
| | J407 | 63.4 | 67 | 8.1 | 62.4 | 0.5 | 0.4 |
| | J408 | 65.6 | 69.5 | 9 | 60.8 | 0.2 | 0.4 |
| | J409 | 67.6 | 71.8 | 8.7 | 59 | 0.2 | 0.2 |
| Cold Rolled 58% | J404 | 68.9 | 72.1 | 2.8 | 65 | Not measured | |
| | J405 | 71.5 | 74.6 | 1.6 | 61.7 | | |
| | J406 | 74.5 | 77.4 | 1.5 | 61.8 | | |
| | J407 | 75.5 | 78.4 | 2 | 59.2 | | |
| | J408 | 79.7 | 82.7 | 1.4 | 57.4 | | |
| | J409 | 82.4 | 85.5 | 1.3 | 54.8 | | |
| Cold Rolled 58% + 275° C./4 hours | J404 | 64.9 | 68.2 | 4.3 | 66.1 | 0.9 | 0.9 |
| | J405 | 67.5 | 70.4 | 4.1 | 62.3 | 0.7 | 0.7 |
| | J406 | 70.4 | 73.6 | 4.9 | 63.8 | 0.7 | 0.7 |
| | J407 | 70.2 | 73.2 | 4.4 | 60.6 | 0.4 | 0.9 |
| | J408 | 75.7 | 79.3 | 5.8 | 61.8 | 0.7 | 0.4 |
| | J409 | 76.4 | 80 | 5.6 | 56.8 | 0.3 | 0.7 |

*0.2% offset yield strength/tensile strength/% elongation, 2-inch gauge length
YS = Yield Strength at room temperature
TS = Tensile Strength at room temperature
EL = Elongation at room temperature
MBR/t = Minimum Bend Radius/thickness MBR/t refers to a 90° bend test in which the "good way" bend was made in the plane of the sheet about an axis in the plane of the sheet that is perpendicular to the longitudinal direction (rolling direction) of the sheet during thickness reduction of the strip. The "bad way" bend was made in the plane of the sheet about an axis parallel to the rolling direction. Bend formability was recorded as MBR/t, the minimum bend radius at which cracking was not apparent, divided by the thickness of the strip.

Stress relaxation data is reported in Table 3. "Long." refers to the longitudinal, or rolling direction, of the strip. "Trans." refers to a direction transverse to the rolling direction of the strip.

TABLE 3

Stress Relaxation Data

| Alloy | Condition | Test Temp. (° C.) | Orientation | % Stress Remaining | | | Slope Change | |
|---|---|---|---|---|---|---|---|---|
| | | | | 1 hr. | 1000 hrs. | 3000 hrs. | Time (hrs.) | % SR |
| J404 | Cold Rolled 30% + 300° C./4 hours | 105 | Long. | 90.0 | 78.6 | 76.3 | 43.4 | 85.0 |
| | | | Trans. | 86.9 | 69.1 | 65.8 | 40.2 | 78.8 |
| | | 125 | Long. | 88.9 | 75.0 | 72.1 | 410.0 | 77.4 |
| | | | Trans. | 83.5 | 63.0 | 58.8 | 96.1 | 72.0 |
| | | 150 | Long. | 83.8 | 63.4 | 59.4 | 97.9 | 71.9 |
| | | | Trans. | 80.4 | 52.2 | 46.0 | 339.9 | 58.3 |
| | Cold Rolled 58% + 275° C./4 hours | 105 | Long.* | 90.1 | 79.0 | 76.6 | 5.5 | 87.6 |
| | | | Trans. | 84.4 | 63.4 | 59.5 | 76.5 | 72.4 |
| | | 125 | Long. | 88.7 | 76.5 | 74.6 | Single Line | |
| | | | Trans. | 77.1 | 57.9 | 54.1 | 22.6 | 71.1 |
| | | 150 | Long. | 85.6 | 70.8 | 66.8 | 854.2 | 71.4 |
| | | | Trans. | 76.3 | 47.7 | 43.1 | 21.7 | 63.8 |
| J405 | Cold Rolled 30% + 300° C./4 hours | 105 | Long. | 96.3 | 93.6 | 91.8 | 97.7 | 97.5 |
| | | | Trans. | 97.1 | 87.9 | 85.7 | 51.2 | 94.8 |
| | | 125 | Long. | 97.6 | 86.1 | 82.7 | 230.6 | 90.5 |
| | | | Trans. | 96.7 | 82.1 | 78.2 | 205.4 | 87.7 |
| | | 150 | Long. | 94.5 | 76.7 | 72.9 | 74.1 | 85.7 |
| | | | Trans. | 94.1 | 72.4 | 67.2 | 170.2 | 80.9 |
| | Cold Rolled 58% + 275° C./4 hours | 105 | Long. | 98.7 | 86.9 | 84.4 | 149.1 | 91.2 |
| | | | Trans. | 96.0 | 82.6 | 79.3 | 74.4 | 90.5 |
| | | 125 | Long. | 94.9 | 82.9 | 80.3 | 65.1 | 89.3 |
| | | | Trans. | 95.4 | 75.9 | 71.7 | 83.3 | 85.6 |
| | | 150 | Long. | 93.0 | 75.6 | 72.2 | 23.0 | 87.3 |
| | | | Trans. | 92.5 | 64.7 | 59.5 | 51.4 | 78.8 |
| J406 | Cold Rolled 30% + 300° C./4 hours | 105 | Long. | 98.1 | 92.4 | 91.0 | 17.9 | 97.8 |
| | | | Trans. | 98.0 | 90.0 | 88.2 | 36.3 | 95.2 |
| | | 125 | Long. | 96.7 | 87.2 | 83.7 | 288.3 | 91.2 |
| | | | Trans. | 98.1 | 85.1 | 81.3 | 133.2 | 92.2 |
| | | 150 | Long. | 95.6 | 77.5 | 73.5 | 71.9 | 87.2 |
| | | | Trans. | 95.3 | 74.9 | 69.9 | 112.3 | 85.0 |
| | Cold Rolled 58% + 275° C./4 hours | 105 | Long. | 97.3 | 91.5 | 88.9 | 211.6 | 95.0 |
| | | | Trans. | 95.1 | 85.1 | 82.5 | 57.0 | 91.9 |
| | | 125 | Long. | 97.6 | 87.5 | 83.7 | 302.0 | 91.6 |
| | | | Trans. | 97.3 | 79.1 | 74.5 | 132.2 | 87.6 |
| | | 150 | Long. | 92.6 | 74.9 | 71.1 | 44.0 | 85.6 |
| | | | Trans. | 94.4 | 67.5 | 62.2 | 30.4 | 84.2 |
| J407 | Cold Rolled 30% + 300° C./4 hours | 105 | Long. | 98.7 | 94.3 | 93.0 | 46.2 | 98.1 |
| | | | Trans. | 98.5 | 92.5 | 90.7 | 74.9 | 96.6 |
| | | 125 | Long. | 97.1 | 89.0 | 85.4 | 205.7 | 94.1 |
| | | | Trans. | 98.2 | 86.2 | 82.5 | 131.2 | 93.2 |
| | | 150 | Long. | 96.4 | 78.1 | 73.7 | 45.1 | 90.5 |
| | | | Trans. | 96.7 | 75.4 | 69.9 | 89.4 | 87.4 |
| | Cold Rolled 58% + 275° C./4 hours | 105 | Long. | 98.2 | 92.0 | 89.8 | 125.4 | 96.1 |
| | | | Trans. | 98.4 | 91.3 | 88.5 | 267.8 | 94.8 |
| | | 125 | Long. | 98.8 | 88.6 | 84.8 | 320.3 | 92.5 |
| | | | Trans. | 98.2 | 83.7 | 79.5 | 125.3 | 91.7 |
| | | 150 | Long. | 96.4 | 78.9 | 74.9 | 40.7 | 90.6 |
| | | | Trans. | 97.1 | 73.1 | 67.8 | 28.9 | 90.0 |

TABLE 3-continued

Stress Relaxation Data

| | | | | | | | | |
|---|---|---|---|---|---|---|---|---|
| J408 | Cold Rolled 30% + 300° C./4 hours | 105 | Long. | 98.9 | 95.8 | 94.9 | 48.8 | 98.5 |
| | | | Trans. | 98.9 | 94.9 | 93.9 | 53.4 | 97.7 |
| | | 125 | Long. | 97.5 | 90.9 | 87.6 | 252.1 | 95.1 |
| | | | Trans. | 97.6 | 89.3 | 85.4 | 273.7 | 93.9 |
| | | 150 | Long. | 97.1 | 79.9 | 75.0 | 100.9 | 90.2 |
| | | | Trans. | 96.7 | 76.8 | 71.0 | 116.2 | 88.3 |
| | Cold Rolled 58% + 275° C./4 hours | 105 | Long. | 99.2 | 94.7 | 93.2 | 95.2 | 97.9 |
| | | | Trans. | 97.6 | 93.5 | 91.7 | 155.1 | 96.5 |
| | | 125 | Long. | 98.0 | 91.6 | 87.9 | 287.7 | 95.9 |
| | | | Trans. | 97.9 | 87.1 | 83.3 | 133.2 | 94.2 |
| | | 150 | Long. | 97.6 | 79.9 | 75.2 | 54.6 | 92.3 |
| | | | Trans. | 98.0 | 74.5 | 67.8 | 97.7 | 88.6 |
| J409 | Cold Rolled 30% + 300° C./4 hours | 105 | Long. | 99.0 | 96.2 | 95.4 | 38.3 | 98.5 |
| | | | Trans. | 98.7 | 94.9 | 94.0 | 48.4 | 97.5 |
| | | 125 | Long. | 98.7 | 92.7 | 90.2 | 146.9 | 97.2 |
| | | | Trans. | 98.4 | 90.5 | 87.2 | 289.8 | 94.2 |
| | | 150 | Long. | 97.6 | 81.5 | 76.9 | 51.1 | 94.1 |
| | | | Trans. | 97.0 | 78.8 | 73.0 | 114.2 | 90.4 |
| | Cold Rolled 58% + 275° C./4 hours | 105 | Long. | 98.5 | 95.4 | 94.3 | 128.7 | 97.6 |
| | | | Trans. | 98.1 | 94.7 | 93.4 | 106.8 | 97.4 |
| | | 125 | Long. | 99.7 | 92.8 | 89.4 | 259.4 | 97.0 |
| | | | Trans. | 98.5 | 90.2 | 86.4 | 306.2 | 94.4 |
| | | 150 | Long. | 98.1 | 82.9 | 78.6 | 59.4 | 94.1 |
| | | | Trans. | 97.8 | 76.3 | 70.4 | 64.4 | 91.2 |

FIGS. 3–8 graphically illustrate a criticality of 0.1%, by weight, minimum magnesium in the alloy for enhanced resistance to stress relaxation. As magnesium is added to the alloy, the resistance to stress relaxation is significantly increased up to a magnesium content of about 0.1%, by weight. Above 0.1%, by weight, further additions of magnesium have a lesser effect on resistance to stress relaxation. A second benefit apparent from FIGS. 3–8 is a reduction in resistance to stress relaxation directionality. The difference in resistance to stress relaxation as measured along a transverse axis of the strip increases to be approximately equivalent (i.e. within about 2% stress remaining) to the resistance to stress relaxation as measured along a longitudinal axis of the strip.

Example 2

A copper alloy of the invention was direct chill (DC) cast 22 with a target composition for the addition of magnesium of 0.15–0.2%, by weight. Chemical analysis was conducted at final gauge 34 where properties were also determined. The alloy had a nominal composition, by weight, of: 2.20% iron, 0.10% zinc, 0.035% phosphorus, 0.17% magnesium and the balance copper and unavoidable impurities. Two bars were cast, followed by hot rolling 24 (from around 900° C.) followed by milling to remove surface oxide.

Three tempers were produced, all relief annealed (RA) 40, that are denoted as: HR02 (Half-Hard/RA), HR04 (Hard/RA) and HR08 (Spring/RA). The process starting with milled hot rolled plate, was as follows: (1) break down cold roll 26 to in excess of a 50% reduction in thickness, (2) bell anneal 28 at 550°–570° C. for around 10–15 hours at temperature, (3) cold roll 30 to reduce thickness by between 30 and 75%, (4) bell anneal 36 at around 460°–470° C. for 6 to 10 hours at temperature, (5) cold rolling 38 to final gauge 34 with a thickness reduction, Δ, according to desired temper: Δ=12% (half-hard condition), Δ=30% (hard condition) and Δ=60% (spring condition). Where indicated in Table 4, the alloys were then (6) relief annealed 40 at around 400° C. for a time of 2–5 minutes at temperature, which is roughly equivalent to a more prolonged anneal at 260° C. for around 2 hours at temperature. The several holding times at temperature are estimates from commercial furnace cycle times.

Tensile properties (as-rolled 38 and after stress relief anneal 40) and conductivity (only after stress relief anneal 40) are summarized in Table 4. Notable at the level of magnesium in accordance with this invention is that the values shown for electrical conductivity are typical for commercially manufactured C19400 and exceed the 60% IACS minimum set as the commercial limit for this alloy.

TABLE 4

TENSILE PROPERTIES OF THE INVENTIVE ALLOYS

| FINAL TEMPER | RELIEF ANNEAL USED | CONDITION | TS (ksi) | 0.2% YS (ksi) | % EL | % IACS |
|---|---|---|---|---|---|---|
| HR02 | 260° C. × | As-Rolled | 64 | 63 | 15 | |
| | 2 hrs | SR Annealed | 62 | 57 | 17 | 65 |
| HR04 | 400° C. × | As-Rolled | 74 | 73 | 4 | |
| | 2 mins | SR Annealed | 68 | 64 | 12 | 67 |
| HR08 | 380° × | As-Rolled | 84 | 82 | 4 | |
| | 2 mins | SR Annealed | 79 | 74 | 6 | 65 |

*Average of front and back of coils
hrs = hours, mins = minutes.

The stress relaxation properties of the alloy are summarized in Table 5 where the properties are also compared to standard, CDA-registered chemistry, alloy C19400. The Special Light Anneal-Relief Anneal temper is equivalent to the HR02 (Half-Hard/Relief Annealed) temper of the alloy of the invention.

TABLE 5

STRESS RELAXATION PERFORMANCE OF ALLOYS OF THE INVENTION AND STANDARD C19400

| ALLOY VARIATION | TEMPER | YS** (0.2%) (ksi) (Long.) | STRESS DIRECTION (Long.-L, Transv.-T) | % STRESS REMAINING 105° C. 1 hr | 105° C. 1000 hrs | 105° C. 3000 hrs | 125° C. 1 hr | 125° C. 1000 hrs | 125° C. 3000 hrs | 150° C. 1 hr | 150° C. 1000 hrs | 150° C. 3000 hrs |
|---|---|---|---|---|---|---|---|---|---|---|---|---|
| CDA | H02 | 55 | L | 91 | 77 | 75 | 87 | 70 | 67 | | | |
| C19400 | (H-Hard) | | T | 90 | 74 | 72 | 87 | 67 | 64 | | | |
| | Spl/LA | 49 | L | 96 | 88 | 87 | | | | | | |
| | | | T | 96 | 86 | 84 | | | | | | |
| Inventive | HR02 | 58 | L | 98 | 95 | 94 | 98 | 91 | 88 | 97 | 77 | 73 |
| Alloy | | | T | 99 | 96 | 95 | 98 | 93 | 90 | n.m* | n.m. | n.m. |
| CDA | H04 | 61 | L | 86 | 71 | 69 | 87 | 68 | 65 | | | |
| C19400 | (Hard) | | T | 87 | 69 | 66 | 86 | 63 | 59 | | | |
| | HR04 | 57 | L | 93 | 81 | 79 | 91 | 76 | 73 | | | |
| | | | T | 92 | 77 | 74 | 89 | 69 | 64 | | | |
| Inventive | HR04 | 63 | L | 99 | 95 | 94 | 98 | 91 | 89 | 98 | 80 | 76 |
| Alloy | | | T | 99 | 95 | 96 | 99 | 89 | 87 | n.m. | n.m. | n.m. |
| CDA | H08 | 70 | L | 92 | 78 | 75 | | | | | | |
| C19400 | (Spring) | | T | 90 | 71 | 68 | | | | | | |
| | HR08 | 67 | L | 96 | 86 | 85 | | | | | | |
| | | | T | 95 | 80 | 77 | | | | | | |
| Inventive | HR08 | 76 | L | 98 | 94 | 93 | 97 | 89 | 86 | 97 | 78 | 74 |
| Alloy | | | T | 99 | 93 | 91 | 98 | 87 | 84 | n.m. | n.m. | n.m. |

*n.m. - not measured
**Test sample values

The magnesium addition significantly reduces the loss in applied stress (shown as the % Stress Remaining from the initially imposed stress) during prolonged exposures at any given temperature. The data shows that alloys within the limits of this invention raise the maximum application or use temperature from around 105° C. to as high as around 150° C.

Furthermore, as shown in Tables 3 and 5 and graphically illustrated in FIGS. 9–11 (plotted from Table 3), magnesium surprisingly reduces directionality of stress relaxation behavior. Typically for this property, the direction transverse to the strip's rolling direction is less stable than the longitudinal direction (parallel to rolling) direction. This directionality is apparent for the data shown in Tables 3 and 5, however, the difference in stress remaining between the two directions is smaller for the magnesium-modified alloy, especially as the percent stress remaining values approach 70%.

Reduced directionality is beneficial to manufacturers who form parts from a copper alloy strip. The strip orientation is less important during manufacturing. Electrical spring contacts are often manufactured by progressive dies that stamp successive components aligned along an axis transverse to the rolling direction of a copper alloy strip. The enhanced resistance to stress relaxation along the transverse axis of the alloys of the inventions is a benefit to electrical spring contact manufacturers.

Example 3

Alloys of this invention were also cast in the laboratory using cathode copper feedstock, processed to the H08 (spring) temper condition, but not relief annealed at final strip thickness. Processing included, after hot rolling, first cold rolling before a first anneal (510° C. ×5 hours at temperature) to 0.120-inch thickness, second cold rolling (55% reduction in thickness) before a second anneal (470° C. ×5 hours) at 0.020-inch thickness and then cold rolled 60% for the H08 (spring-as-rolled temper condition). Properties are compared in Table 6 with lab-cast C19400 prepared by remelting commercial C19400 and processed as described in this Example 3.

TABLE 6

PROPERTIES OF LAB-PROCESSED ALLOYS

| Lab Ingot # | Analyzed Composition (Percent) Fe | P | Zn | Mg | S (ppm) | TS/YS/El.* (ksi/ksi/%) | % IACS | % Stress Remaining (1000 hrs) 125° C. | 150° C. |
|---|---|---|---|---|---|---|---|---|---|
| H298 | 1.9 | <0.01 | 0.14 | none | 48 | 72/69/2 | 66 | 66 | 60 |
| H300 | 2.0 | 0.04 | — | 0.12 | 8 | 79/76/2 | 62 | 71 | 65 |

TABLE 6-continued

PROPERTIES OF LAB-PROCESSED ALLOYS

| Lab Ingot # | Analyzed Composition (Percent) Fe | P | Zn | Mg | S (ppm) | TS/YS/EI.* (ksi/ksi/%) | % IACS | % Stress Remaining (1000 hrs) 125° C. | 150° C. |
|---|---|---|---|---|---|---|---|---|---|

ppm = parts per million
*Tensile Strength/0.2% Yield Strength/% Elongation (2-inch gage)

As shown in Table 6, the alloys in accordance with the preferred embodiment of this invention also had improved stress relaxation resistance in the as-rolled temper condition. A comparison with Table 5 shows that relief annealing acts to significantly further improve stress relaxation performance.

The term "ksi" as used herein is an abbreviation for thousands of pounds per square inch. The term "mm" as used herein is an abbreviation for millimeters. Stress relaxation properties as set forth herein were tested in accordance with ASTM Standard Recommended Practice E328-78 using the force required to lift the specimen just free of one or more constraints during the test period (Section 28.1.2).

It is apparent that there has been provided in accordance with the invention a copper alloy that fully satisfies the objects, means and advantages set forth hereinabove. While the invention has been described in combination with embodiments thereof, it is apparent that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A copper alloy having improved stress relaxation resistance, said copper alloy consisting essentially of:

from 1.8 to 3.0 weight percent iron;

from 0.01 to 1.0 weight percent zinc;

from 0.001 to 0.25 weight percent phosphorous;

from greater than 0.11 to 0.35 weight percent of free magnesium;

less than 0.2 weight percent titanium less than 0.1 weight percent tin; and the balance copper and unavoidable impurities whereby said copper alloy is substantially free of magnesium phosphide inclusions and has an electrical conductivity of greater than or equal to 60% IACS.

2. The copper alloy of claim 1 wherein said iron content is, by weight, from 2.0% to 2.7%.

3. The copper alloy of claim 2 wherein said magnesium content is, by weight, from 0.11% to 0.30%.

4. The copper alloy of claim 3 wherein said zinc content is, by weight, from 0.01% to 0.50%.

5. The copper alloy of claim 4 wherein said alloy has a resistance to stress relaxation in a direction transverse to a rolling direction that is within about 3% of a resistance to stress relaxation in a direction longitudinal to said rolling direction when exposed to 105° C. for 3000 hours following 30% cold rolling and annealing at 300° C. for 4 hours.

6. The copper alloy of claim 4 wherein at least a portion of said iron is replaced with cobalt on a 1:1, by weight, basis.

7. A copper alloy having improved stress relaxation resistance, said copper alloy consisting essentially of:

from 2.1 to 2.6 weight percent iron;

from 0.05 to 0.25 weight percent zinc;

from 0.01 to 0.09 weight percent phosphorous;

from greater than 0.12 to 0.25 weight percent of free magnesium;

less than 0.2 weight percent titanium;

less than 0.1 weight percent tin; and the balance copper and unavoidable impurities whereby said copper alloy is substantially free of magnesium phosphide inclusions and has an electrical conductivity greater than or equal to 60% IACS.

8. The copper alloy of claim 7 wherein said alloy has a resistance to stress relaxation in a direction transverse to a rolling direction that is within about 3% of a resistance to stress relaxation in a direction longitudinal to said rolling direction when exposed to 105° C. for 3000 hours following 30% cold rolling and annealing at 300° C. for 4 hours.

9. The copper alloy of claim 7 wherein at least a portion of said iron is replaced with cobalt on a 1:1, by weight, basis.

* * * * *